United States Patent [19]

Frank

[11] 4,431,883

[45] Feb. 14, 1984

[54] DUAL ACTION SWITCH ASSEMBLY

[75] Inventor: Robert B. Frank, Morris Plains, N.J.

[73] Assignee: General Automotive Specialty Co., Inc., Carlstadt, N.J.

[21] Appl. No.: 350,630

[22] Filed: Feb. 22, 1982

[51] Int. Cl.[3] ..... H01H 15/08

[52] U.S. Cl. ..... 200/67 D; 200/62; 200/244; 200/250; 200/153 LA

[58] Field of Search ..... 200/62, 76, 154, 327, 200/5 E, 5 B, 153 LA, 244, 250, 67 D

[56] References Cited

U.S. PATENT DOCUMENTS

| | | | |
|---|---|---|---|
| 3,189,700 | 6/1965 | Eidson | 200/153 LA |
| 3,275,768 | 9/1966 | Batcheller | 200/76 |
| 3,676,625 | 7/1972 | Blatt | 200/5 E X |
| 3,973,094 | 8/1976 | Kuhn | 200/76 X |

FOREIGN PATENT DOCUMENTS

| | | | |
|---|---|---|---|
| 217006 | 6/1909 | Fed. Rep. of Germany | 200/153 LA |

*Primary Examiner*—John W. Shepperd
*Assistant Examiner*—Renee S. Kidorf
*Attorney, Agent, or Firm*—Darby & Darby

[57] ABSTRACT

This invention relates to an improved dual action switch assembly in which each of two pairs of electrical contacts is alternatively locked in open position by a tensioned locking element upon the interaction of a driving mechanism partially positioned within a frame on a slider unit. The switch assembly in a preferred form includes a base, two movable contact arms and two corresponding fixed contact brackets mounted on the base. The contact arms are mounted for pivotal rotation about mounting terminals. A biasing member, as for example a coil spring, is attached to each of the contact arms to provide a resilient force against pivoting opening movement of the contact arms. A tensioned locking element, preferably formed of two bent, overcenter, leaf springs, is mounted between the slider unit and the base. The slider unit is capable of slidable movement along the base upon the action of a driving mechanism such that the slider unit alternatively contacts one of the contact arms at a time, causing that contact arm to pivot and separate from its connection with its corresponding contact bracket. When this occurs the tensioned locking element locks the contact arm and contact bracket in an open position until the driving mechanism reverses to cause the slider unit to actuate the other contact arm, causing the tensioned locking element to unlock, move through its maximum point of tension and relock the latter contact arm and contact bracket in open position.

11 Claims, 10 Drawing Figures

DUAL ACTION SWITCH ASSEMBLY

This invention relates to an improved switch assembly and more particularly to a dual action, fast-breaking, switch assembly having a slider unit, at least one tensioned locking element and two pairs of electrical contacts, one pair of the contacts being in a closed position when the other pair of contacts is locked in an open position, and each pair of contacts being adapted to be locked alternatively in open position by the tensioned locking element upon the interaction of a driving mechanism with the slider unit.

BACKGROUND OF THE INVENTION

Conventional dual action switch assemblies are used, for example, in certain vehicles, such as large load-containing trucks, which are equipped with high and low range rear axle gears. By shifting the rear axle gears from one range to the other the operator may multiply the number of available gears such that the driving forces applied to the wheels are selectively adapted to varying road resistance conditions. The mechanical shifting of the rear axle gears may be accomplished by the action of an axle shift fork device which is controlled by an electric shift unit. The electric shift unit includes a reversible D.C. electric motor, a drive screw assembly and a switch assembly. A conventional switch assembly includes a base carrying two spaced pairs of contacts. Each pair has a fixed contact and a movable contact, normally spring biased into contact with one another. A drive pin, actuated by a reversible motor, is arranged to separate one of the pairs of contacts when the pin is driven in one direction, and to separate the other pair of contacts when driven in the other direction. The separation of the contacts stops the motor. In this way the drive pin may be moved to either of two limiting positions, depending on the direction of rotation of the reversible motor, and thereby cause the desired gear shifting.

However, in such a system, vibration, inertia or other effects may cause the opened contacts to close momentarily which will restart the motor in a direction to open the contacts. Such on-off cycling of the motor may be repeated indefinitely, and cause arcing, resulting in contact erosion and high heat generation in the switch assembly. This in turn may fuse contacts, causing the motor to operate beyond its desired limit and possibly to stall and burn out. As a result of such on-off cycling and arcing, there may be failure of the drive screw assembly, electric motor or switch; requiring frequent replacement.

OBJECTS OF THE INVENTION

Therefore, it is an object of the present invention to provide an improved dual action switch asembly which locks one of two pairs of electrical contacts in an open position while simultaneously permitting the second pair of electrical contacts to come to a closed position and avoiding the problems of prior art dual action switch assemblies.

Another object of this invention is to provide a switch assembly in which the contact arms and contact brackets are physically isolated from the switch driving mechanism.

A further object of this invention is to provide a fast breaking and locking dual-action switch assembly having a tensioned locking element, isolated from the driving mechanism, to avoid arcing and premature failure of the switch assembly.

SUMMARY OF THE INVENTION

In accordance with the invention an improved dual action switch comprises a base, and two pairs of contacts mounted on the base, each pair having a movable contact arm mounted pivotally on the base and a fixed contact bracket, with a spring normally urging the arm against the bracket. Means are provided to open one pair of contacts with a fast snap action when the drive pin approaches one end of its travel, while the other pair remains closed, and to retain the open contacts essentially locked in their position independently of the drive pin position until the drive pin is caused to approach the opposite end of its travel. This is done by a tensioned locking device.

In a preferred embodiment of the invention, the tensioned locking device comprises two bent leaf over-center springs which are isolated from the contact arms, contact brackets, biasing means and driving means, and are operative to provide fast breaking and locking action for the contact arms and corresponding contact brackets.

BRIEF DESCRIPTION OF THE DRAWINGS

The following detailed description of a preferred form of the invention will be best understood in conjunction with the accompanying drawings in which.

DETAILED DESCRIPTION OF A PREFERRED EMBODIMENT

Figure 10:
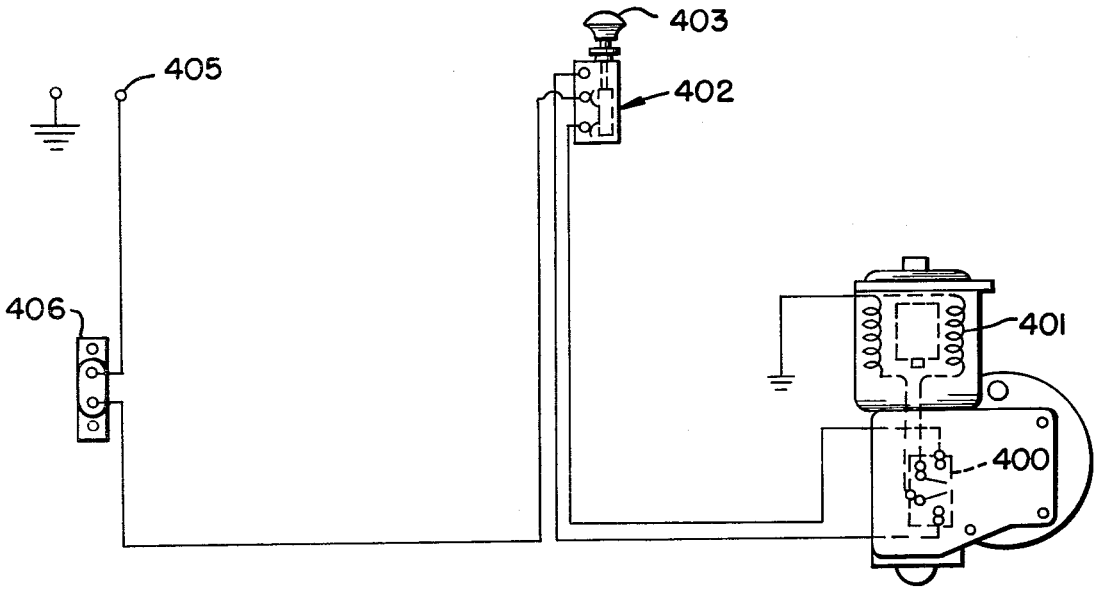
FIG. 10 is a schematic diagram of a circuit employing the switch assembly of the present invention in an electric shift unit used to shift rear axles.

To aid in understanding the present invention, reference is made to the circuit of FIG. 10. The electric shift unit shown in FIG. 10 contains an automatic switch assembly 400, described below, an electric motor 401, a control switch 402 and switch knob 403, a power source 405 and a circuit breaker 406. The motor circuit is completed by manually actuating the control knob 403 which closes the circuit in the motor 401 and provides current flow through the switch assembly 400 to operate the motor 401. The motor operates until at the end of its travel it is stopped by opening the contacts of switch 400. If the control switch 402 is actuated to its other position, the motor operates in the reverse direction, allowing the opened contacts to close. The motor continues until it causes the other contact pair to open, when the motor is stopped. In this way, the automatic switch assembly controls causing the motor to assume one of two fixed positions. The switch structure of the invention for use in such a system is now described.

Figure 2:
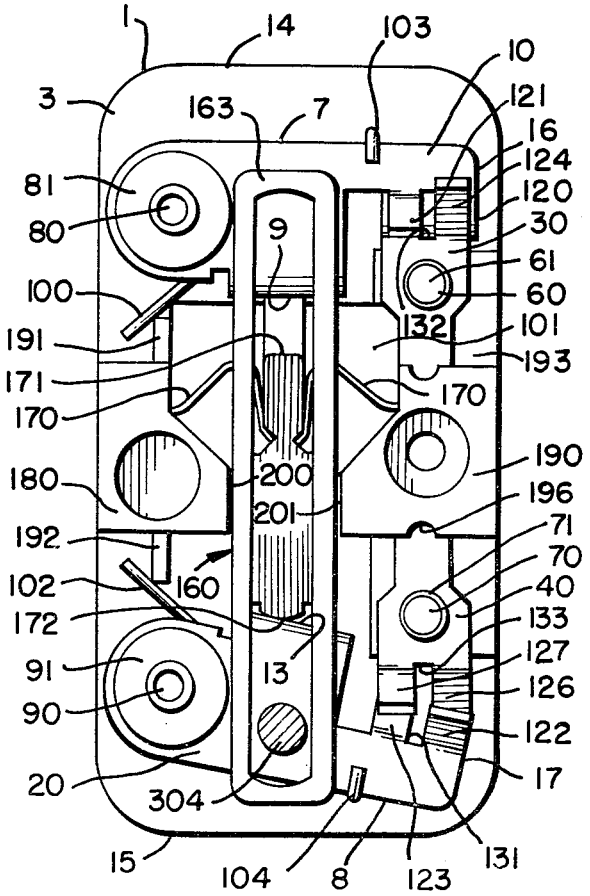
FIG. 2 is a top plan view of the switch assembly of FIG. 1.
Figure 4:
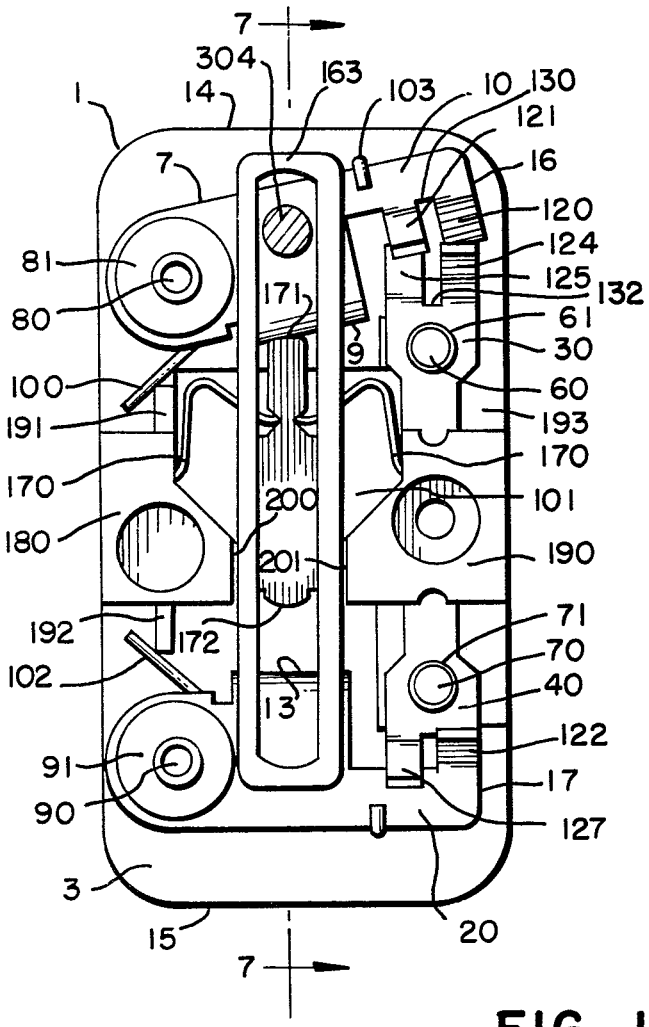
FIG. 4 is a top plan view of the switch assembly in a second operating position showing the first contact arm separated from the corresponding contact bracket and the second contact arm connected with the second corresponding contact bracket.

FIGS. 2 and 4 show top plan views of the switch assembly embodying the present invention in each of its two final operating positions. Referring to FIGS. 2 and 4, the switch assembly has a base 1 having generally oppositely disposed ends designated as 14 and 15 and two pairs of contacts. Contact arm 10 and contact bracket 30 form a first contact pair, and contact arm 20 and contact bracket 40 form a second contact pair. FIG. 2 shows the first contact pair (contact arm 10 and contact bracket 30) in the closed position and the second contact pair (contact arm 20 and contact bracket 40) in the separated position. FIG. 4 shows the first contact pair 10, 30 in the open position and the second contact pair in the closed position. Since the two contact pairs are similar in construction, the structure for pair 10, 30 will be described in detail here.

The contact bracket 30 is securely mounted on the switch base 1, on surface 193 as by a mounting terminal or screw 60. Contact brackets 30 and 40 may include rounded protruberances which mate with notches 195 and 196 respectively on projections 190 of the base 1. Mounting terminal 60 is preferably formed with a partially or wholly threaded post, portion 61 at one end and a head 62 at the other end. The post portion 61 passes through the switch base 1 and the contact bracket 30. The head portion 62 of the mounting terminal 60 is preferably recessed at 45 in the bottom 2 of the switch base 1, (FIG. 6) so that the head portion 62 does not protrude from the bottom 2 of the switch base 1. The threaded portion of the terminal 61 extends above the contact bracket 30 and may be connected to an outside circuit. Terminal 60 and contact bracket 30 are made of an electrically conductive material, such as copper, while switch base 1 is made of a nonconductive insulating material. Mounting terminal or screw 70 corresponds to mounting terminal 60 and includes a partially or wholly threaded post portion 71 at one end and a head 72 at the other end. The post portion of terminal 70 passes through the switch base 1 and the contact bracket 40. Head 72 is similarly recessed at 45 in the bottom of switch base 1. Terminal 70 corresponds in all other respects to terminal 60 described hereinabove.

Figure 1:
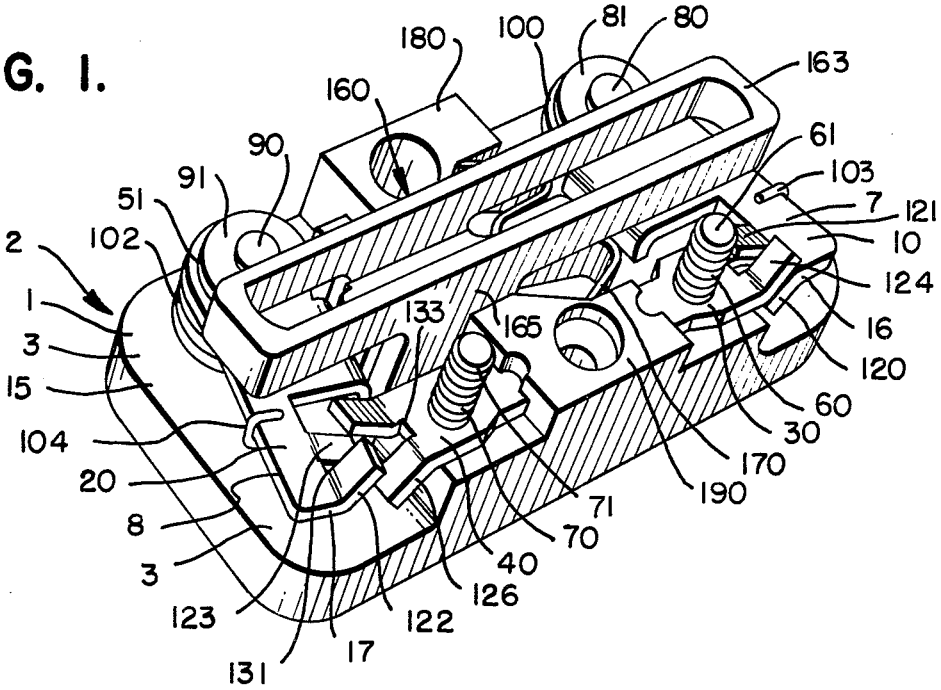
FIG. 1 is a perspective view of the preferred switch assembly of the present invention in a first operating position showing a first contact arm connected with its corresponding contact bracket and a second contact arm separated from its corresponding contact bracket.
Figure 3:
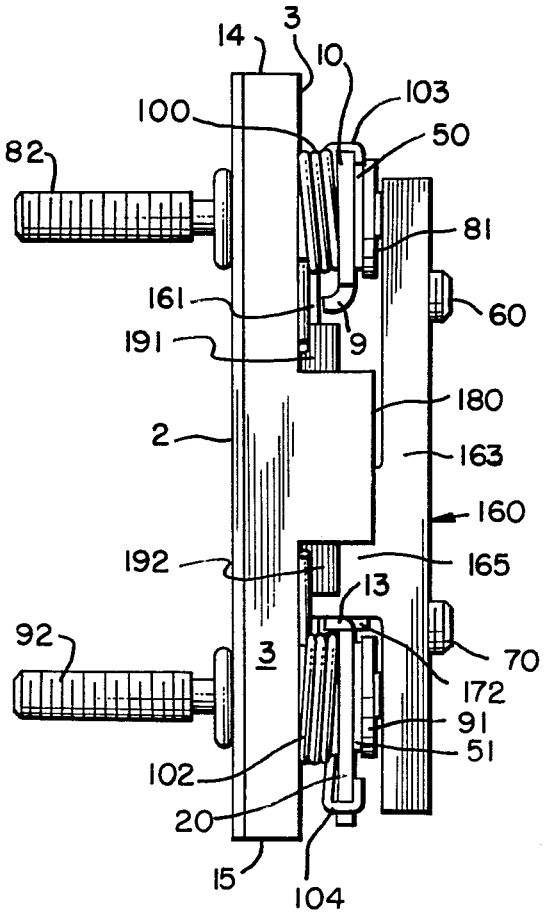
FIG. 3 is a side elevation view of the switch assembly of FIGS. 1 and 2.
Figure 8:
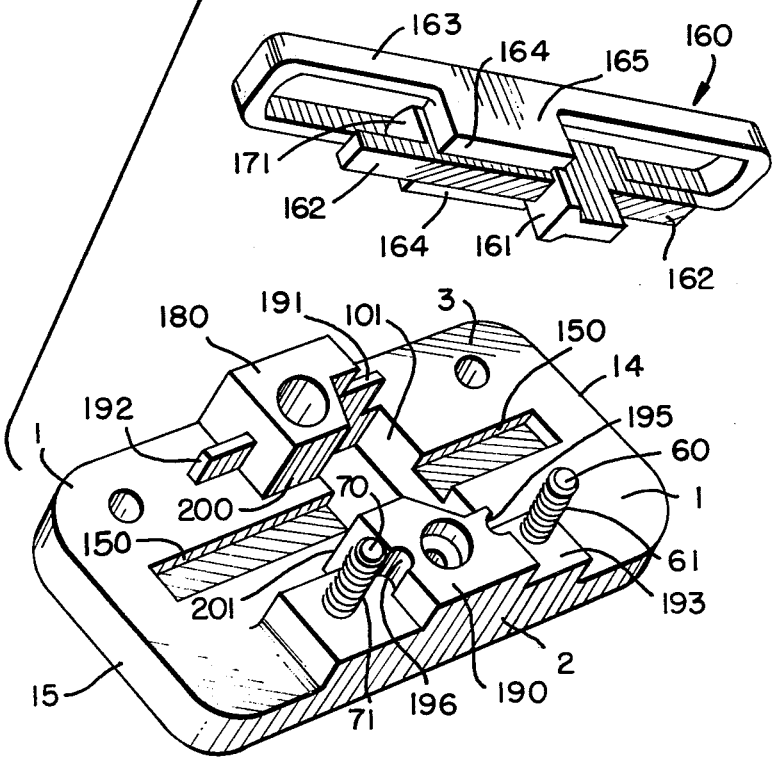
FIG. 8 is an exploded perspective view of the switch assembly of the present invention illustrating the relationship of the slider unit to the switch base.

The contact arm 10 is also mounted on switch base 1, on a second mounting terminal or screw 80 having a head portion 81 and a partially or wholly threaded post portion 82 extending through to the opposite side of the base 1. Similarly, contact arm 20 is mounted on the switch base on a second mounting terminal or screw 90 which also includes a head portion 91 and a partially or wholly threaded post portion 92 extending through the opposite side of the base 1. In the same manner as contact arm 10, contact arm 20 will pivot about terminal post 90. The contact arm 10 has a hole through which the terminal post 80 passes so that the contact arm 10 may pivot about the mounting terminal. The length of the mounting terminal 80 above base 1 is sufficient to accept a biasing element, such as, for example, a wound coil spring 100 surrounding post 80 between the top of the base 1 and the horizontal plane of the contact bracket 30. The head 81 of the mounting terminal 80 may be in contact with the contact arm 10, or preferably separated from the contact arm as by a washer 50 (FIG. 3). The head 91 of mounting terminal 90 associated with contact arm 20 is similarly preferably separated from the contact arm 20 by washer 51. Terminal 80 and contact arm 10 are also made of an electrically conductive material such as copper. Coil spring 100 preferably has an end formed with a hook 103 which fits over the top outer edge 7 of the contact arm 10. Similarly, coil spring 102 has a hook end 104 which fits over the top outer edge 8 of the contact arm 20. The other end of the coil springs 100 is fixedly held on the base 1 against a protuberance 191 (FIG. 8). Similarly, coil spring 102 is fixedly held on the base 1 against a protruberance 192. Coil spring 100 resiliently urges the contact arm toward the corresponding contact bracket 30.

The end 16 of the contact arm 10 disposed furthest from the mounting terminal 80 is preferably formed with two oppositely inclined tabs 120, 121. Similarly end 17 of contact arm 20 is formed with two oppositely inclined tabs 122 and 123. The tabs 120, 121 are disposed adjacent to a corresponding set of inclined tabs 124, 125 formed on one end of the contact bracket 30. The tabs 120, 121 are separated by a notch 130. The tabs 124, 125 formed on the contact bracket 30 are also spaced apart from each other on the same contact bracket by a notch 132. Tabs 126 and 127 correspond in function and structure to tabs 124 and 125 but are formed on contact bracket 40. The tabs on the contact arm and the tabs on the corresponding contact bracket are inclined at the same angle, so that the tabs 120,121 on the contact arm 10 easily mate with and make good contact with the tabs 124,125 on the contact bracket 30. Tabs 122 and 123 on contact arm 20 easily mate with and make good contact with tabs 126 and 127 on the contact bracket 40. Notch 131 appears between tabs 122 and 123 while notch 133 appears between tab 126 and 127 which notches are aligned when contact arm 20 mates with contact bracket 40 in the closed position. The alternating and equal upward and downward inclines of the tabs on the contact arm and the corresponding alternating and equal downward and upward inclines of the tabs on the contact bracket allows for good mating or separation of the contact arm and the contact bracket when the contact arm is pivoted towards or away from the contact bracket, so as to close or open the circuit between them.

A second pair of contacts is provided at the opposite end of base 1, formed by contact arm 20 pivotally mounted on terminal post 90, and contact bracket 40 secured to terminal 70. These have the same construction already described as to contact arm 10 and contact bracket 30, with the two brackets 30, 40 extending in opposite directions, and the two contact arms 10, 20 pivoting in opposite directions to make contact with their respective brackets 30, 40. As will be seen from the further description below, the contacts are arranged so that both pairs may be closed at the same time, but only one pair may be opened at a time. The opening or closing of the contacts is determined by the position of a slider element 160 (FIG. 8) which slides longitudinally on base 1, by operation of a drive pin 304 (FIGS. 2 and 4) as will be described.

The base 1 is formed with a central groove 150 (FIG. 8) extending along the top 3 of the base 1 between and beneath the contact arms 10, 20. The slider unit 160 is preferably positioned in the groove 150 for slidable movement as described below. The top 3 of the base 1 is also preferably formed with a well 101 positioned substantially midway between the contact arms 10, 20. The purpose of the well 101 is to provide adequate space in the switch base for the width of the tensioned locking device 170 and to provide a stop for the slider unit as described in more detail below.

Figure 7:
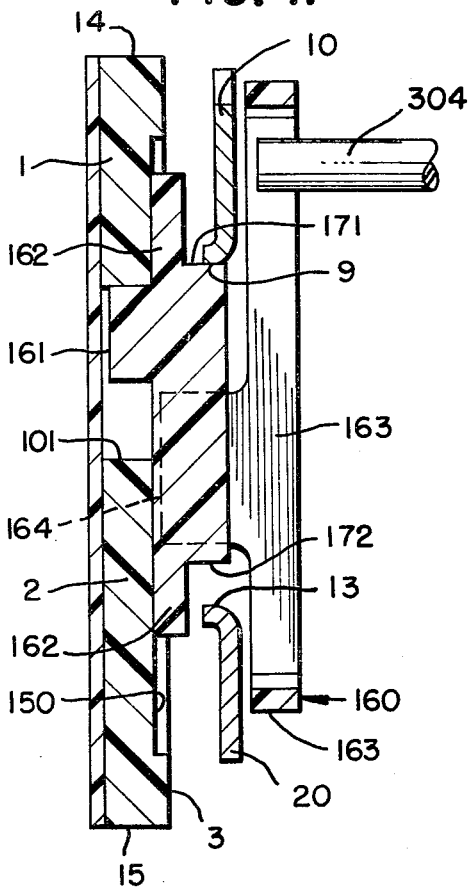
FIG. 7 is a section of the switch assembly taken along lines 7—7 of FIG. 4.

Referring to FIGS. 7 and 8, the slider 160 is preferably formed with a downwardly extending stop member 161, positioned in well 101, and a pair of aligned longitudinal guide members 162 extending outwardly from stop member 161. The guide members 162 are positioned in base groove 150, and guide slider 160 for longitudinal movement relative to base 1. Slider 160 also has a pair of flat surfaces 164 which are parallel to and rest on the top of base 1, and serve as sliding bearing surfaces for slider 160.

Forming part of slider 160 is a frame 163 arranged in a plane parallel to and spaced above base 1. The length of frame 163 is preferably greater than the distance between the mounting terminals 80, 90.

In this preferred form of the invention the inner edges 9, 13 of the contact arms 10, 20 are bent in a direction substantially perpendicular to the contact arms in a direction downwards towards the base 1, as seen in FIG. 7. This bend provides a striking area to cause the contact arms 10, 20 to pivot.

Between the frame 163 and base 1, slider 160 has a pair of space rounded abutments 171, 172, each adapted to contact a respective bent edge 9 or 13 of contact arms 10, 20. This abutment 171 will touch contact edge 9 of contact 10 when slider 160 is in the position shown in FIG. 4, while abutment 172 will touch contact edge 13 in the position of FIG. 2. In this way, the slider may open contacts 10, 30 when at one end of its travel or contacts 20, 40 when at the other end of its travel in groove 150.

Frame 163 is substantially rectangular. It is positioned above the guide element 162 and the horizontal plane of the contact arms and contact brackets by a joining section 165, having the bearing surfaces 164 thereon, and formed with the abutments 171, 172 at its ends. Frame 163 is further located between protruberances 180 and 190 which have bearing surfactes 200 and 201, bearing on slider 160, against which frame 163 and slider 160 slide. The entire slide 160 is preferably molded or fabricated to be integral. A portion of a driving mechanism, such as a drive pin 304 of a drive screw assembly 303, may be positioned within frame 163 so that slider 160 may push against one or the other of the contact arms 10, 20, causing an arm 10 or 20 to pivot and separate from its corresponding contact bracket 30 or 40, as shown in FIG. 7 and as described in more detail below.

Figure 6:
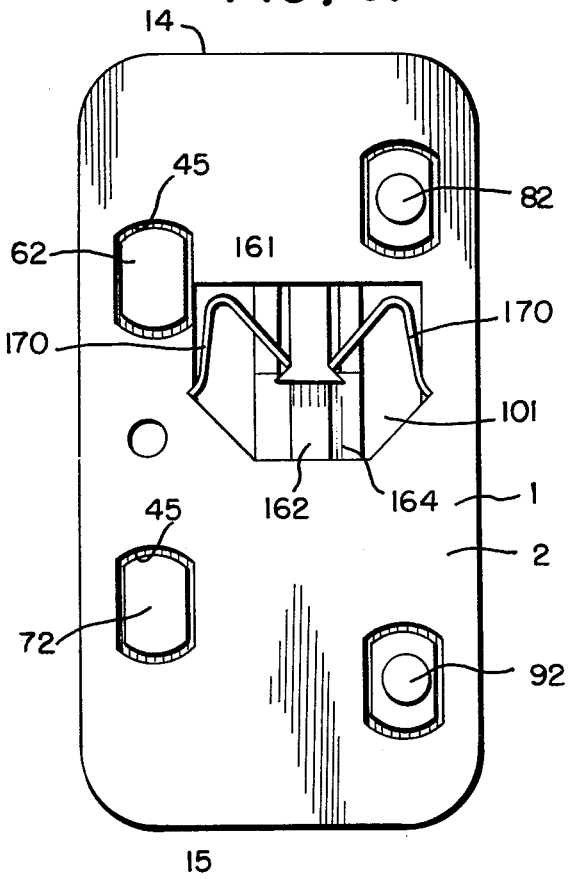
FIG. 6 is a bottom plan view of the switch of FIGS. 4 and 5 in the second operating position.

An important feature of the present invention is the provision of simple means for aiding opening of the contacts of each pair, and retaining them open so long as the slider 160 is positioned at or adjacent one end of its travel. For this purpose, a tensioned locking element 170, such as one or more bent over-center leaf springs, is preferably positioned within the well 101 formed in the base 1 as seen in FIG. 6. Each bent leaf spring 170 is held in the base 1 at one spring end preferably on a notch formed in the projections 180, 190 on the base, and at the other end on a notch in the projection 161 of the center of slider 160. The position of the bent springs 170 within well 101, and the slider 160 is illustrated in FIGS. 4 and 6 when contact arm 10 is separated from its contact bracket 30 (FIG. 4) and when contact arm 10 is connected to contact bracket 30 (FIG. 2).

As the drive pin 304 which is not an integral part of slider 160 forces the frame 163 and slider 160, downward as in FIG. 2, abutment 172 forces movable contact arm 30 away from fixed contact 40, against the resistance of coil spring 102. The bent leaf springs 170 force the slider 160 downward in addition to the action of drive pin 304, and continue the movement of slider 160 even after the drive pin has reached the end of its travel, shown in FIG. 2. The slider 160 is limited in its movement when projection 161 hits the wall of well 101. The springs 170 then tend to hold the slider 160 against upward movement in the figure, since any such movement would attempt to bend the leaf springs 170 further, which creates a greater resilient opposition to such bending.

If drive pin 304 is now moved upwardly, (as by operating reversing switch 403 of FIG. 10) it will move freely within frame 163. However, slider 160 will not move, since leaf springs 170 are much stronger than the coil spring 102. Hence contacts 20, 40 remain open.

This state continues until drive pin 304 hits the top edge of frame 163, which it will then move upwards against the opposition of leaf springs 170. Frame 163 moves slider 160 upwards so that the outer ends of springs 170 will pivot in their notches, while their inner ends move upward. This increases the resilient force exerted by the springs 170, until their outer and inner ends are at the same level, when the separation between these ends is a minimum. At this point, the force exerted by the leaf springs is a maximum, but directed perpendicularly of the slider 160. As the slider 160 moves up further, the leaf springs try to open, forcing the slider 160 upward, in the same direction as the drive pin 304 is moving. The spring action may be made strong enough to continue the movement of the frame without assistance from the drive pin. This over-center action aids in quickly opening the upper contacts 10, 30, in cooperation with the action of abutment 171 on the contact edge 9. In the meantime, the other abutment 172 has moved away from the other contact edge 13, allowing coil spring 102 to close contacts 20,40 to prepare the motor circuit for reverse action when called for by switch 403 (FIG. 10).

The drive pin 304 stops its movement in frame 163 after it has forced the frame and slider past the over-center point of springs 170. The springs now continue the movement of the frame 163. As a result, in the final operating position the frame 163 becomes separated from the drive pin 304, and is stopped only when projection 161 abuts the wall of well 101. The separation between the frame and the drive pin, at the final operating position, prevents vibrational contact between the frame and the drive pin and therefore prevents damage to the frame. This separation of the drive pin and frame at the final operating position allows the drive pin to be formed of a conductive material if desired, since any on-off cycling and resulting arcing cannot occur.

As is readily seen, the leaf springs 170 serve as locking elements to hold slider 160 in place and thereby keep the contact pair open, and also serve to give a snap action to the opening of the contacts.

Figure 9:
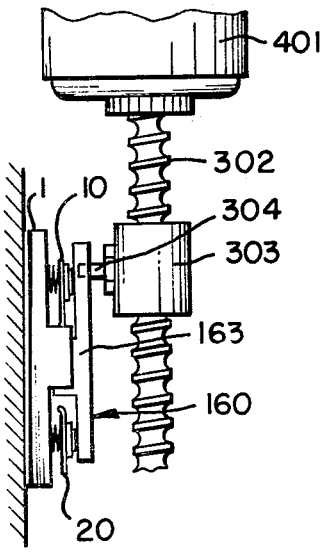
FIG. 9 is an illustration of the driving mechanism useful with the switch assembly of the present invention.

While the operation of the above-described switch assembly embodying the invention may be evident from such description, the following disclosure of the operation of an electric shift unit used to control the shifting of rear axle gears is given for further clarification. FIG. 9 illustrates the switch assembly of the present invention in a representative relationship to a driving mechanism.

The driving means illustrated in FIG. 9 includes a reversible D.C. electric motor 401 having a rotatable shaft, a drive screw 302 attached to the drive shaft of the electric motor 401 for rotation with the shaft, a drive nut 303 on drive screw 302, and a drive pin 304 secured to the drive nut 303. The outer surface of the drive screw 302 and the inner surface of the drive nut 303 are threaded so that the drive nut 303 may travel along the length of the drive screw 302 upon activation of the motor 401 and rotation of its shaft in either the clockwise or counterclockwise direction. The free end of the drive pin 304 may engage the frame 163 of the slider 160 of the switch. The frame 163 of the slider 160 is so formed that the drive pin 304 may move longitudinally within the frame 163.

Figure 5:
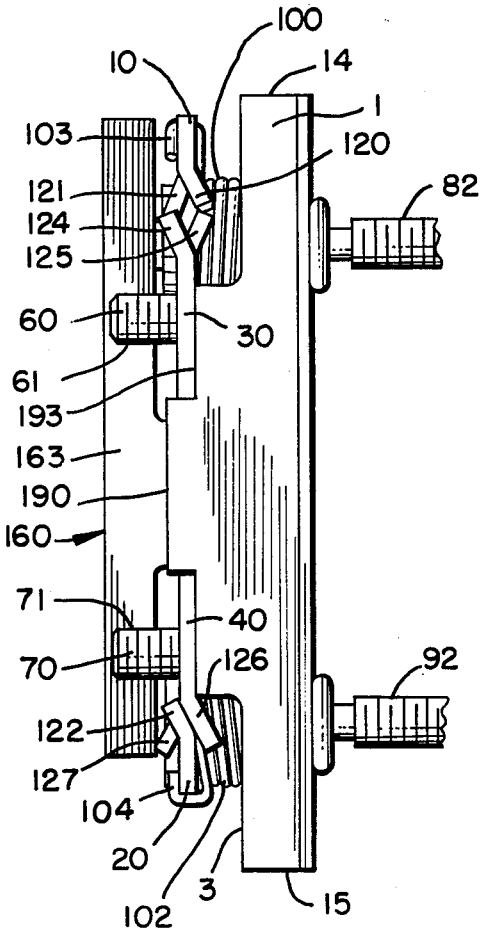
FIG. 5 is a side elevation view of the switch assembly of FIG. 4 in the second operating position.

At the start of the operation, the drive pin 304 is positioned on the drive nut 303 at the top of the drive screw 302 at one end of frame 163 directly above the pivoted disconnected contact arm 10, as shown in FIG. 4. At this position, drive pin 304 has applied sufficient force to the frame 163 to cause the tensioned locking element 170 to lock contact arm 10 in the disconnected position. When the electric shift unit switch 403 (FIG. 10) is actuated (to activate to shift the axle gears, for example) the motor circuit is completed through contact arm 20 and contact bracket 40, as shown in FIG. 5. As the drive shaft 301 of the motor and the drive screw 302 rotates, the drive nut 303 and drive pin 304 move downward along the drive screw 302. The drive pin 304 moves within frame 163 until it reaches the other end of the frame 163, positioned above contact arm 20. As described above, this causes contact arm 20 to pivot and separate from its corresponding contact bracket 40, disconnecting the motor circuit and stopping the motor. Nearly simultaneously with the separation of contact arm 20 from corresponding contact bracket 40, contact arm 10 comes into contact with contact bracket 30 so that the motor is in position to rotate in a reverse direction. Contact arm 20 is then in open position while contact arm 10 is locked in a closed position. In an electric shift system, as the drive nut 303 travels up and down along the drive screw 302, the drive nut 303 contacts an axle shifting control device, which actuates the mechanical axle gear shifting device, as for example an axle shift fork, to shift the rear axle gears.

In this arrangement, the drive pin is free from the switch mechanism except during the actual switching operation, which is accomplished more rapidly than in previous devices. The effects of vibrations or the like are minimized since the bent leaf springs have a locking feature which avoids undesired contact closing and consequent chatter of the motor.

What is claimed is:

1. A dual action switch assembly comprising:

a base;

two spaced pairs of contact members, each pair having a fixed contact member mounted on the base, and a movable contact member mounted on said base for pivotal movement;

resilient biasing members comprised of two springs each of said springs being coupled at one end to said base and at the other end to a respective one of said movable contact members to continuously urge each movable contact member against its corresponding fixed contact member;

a slider unit slidably mounted on said base between said contact member pairs; and at least one tensioned locking element interposed between said base and said slider unit for alternatively holding one or the other of said movable contact members in an open position relative to its corresponding fixed contact member while simultaneously permitting the other movable contact member to be in a closed position relative to its corresponding fixed contact member.

2. A switch assembly according to claim 1 wherein said slider unit further comprises a frame, and a guide member slidably supported on said base between said movable contact members, and an actuating member, each end of said actuating member being positioned adjacent to a respective one of said movable contact members for alternatively contacting said movable contact members, said frame being adapted to act in conjunction with a driving means to cause said tensioned locking element to provide fast breaking and locking action for said movable contact members.

3. A switch assembly according to claim 2 wherein said contact members lie substantially in a common plane substantially parallel to the bottom surface of said base.

4. A switch assembly according to claim 2 wherein said frame, actuating member and guide member are of one piece.

5. A dual action switch assembly comprising:

a base;

two spaced pairs of contact members, each pair having a fixed contact member mounted on the base and a movable contact member mounted on said base for pivotal movement;

a biasing member resiliently urging each movable contact member against its corresponding fixed contact member;

a slider unit comprising a frame substantially parallel to said base and above the plane of said contact members with said frame out of contact with said contact members; and a guide member slidably supported on said base between said movable contact members, and an actuating member, each end of said actuating member being adapted to be positioned adjacent to a respective one of said movable contact members for alternatively contacting said movable contact members;

at least one tensioned locking element operatively coupled to the actuating member of said slider unit for alternatively holding one or the other of said movable contact members in an open position relative to its corresponding fixed contact member while simultaneously permitting the other movable contact member to be in a closed position relative to its corresponding fixed contact member; and wherein said frame is adapted to act in conjunction with a driving means to cause said tensioned locking element to provide fast breaking interlocking action for said movable contact members.

6. A switch assembly according to claim 1 or 5 wherein each tensioned locking element comprises a bent over-center leaf spring, said leaf spring being isolated from said contact member and said biasing members, each said leaf spring bearing on said base and said